US010470550B2

(12) United States Patent
Salciarini et al.

(10) Patent No.: US 10,470,550 B2
(45) Date of Patent: Nov. 12, 2019

(54) COSMETIC POT COMPRISING A LID WITH A GUIDED COUPLING MEMBER

(71) Applicant: CHANEL PARFUMS BEAUTE, Neuilly-sur-Seine (FR)

(72) Inventors: Christian Salciarini, Hyeres (FR); Julien Chandelier, Longjumeau (FR); Gregory Perbal, Verrieres le Buisson (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 265 days.

(21) Appl. No.: 15/546,550

(22) PCT Filed: Feb. 8, 2016

(86) PCT No.: PCT/FR2016/050265
§ 371 (c)(1),
(2) Date: Oct. 18, 2017

(87) PCT Pub. No.: WO2016/128660
PCT Pub. Date: Aug. 18, 2016

(65) Prior Publication Data

US 2018/0242712 A1 Aug. 30, 2018

(30) Foreign Application Priority Data

Feb. 9, 2015 (FR) ..... 15 51009

(51) Int. Cl.

| | |
|---|---|
| ***B65D 55/12*** | (2006.01) |
| ***A45D 40/00*** | (2006.01) |
| ***A45D 33/00*** | (2006.01) |
| *B65D 53/04* | (2006.01) |

(52) U.S. Cl.
CPC ..... *A45D 40/0068* (2013.01); *A45D 33/003* (2013.01); *B65D 55/12* (2013.01); *A45D 2200/051* (2013.01); *B65D 53/04* (2013.01)

(58) Field of Classification Search
CPC ..... A45D 40/023; A45D 33/16; A45D 33/12; B65D 55/12
USPC ..... 132/326, 293; D23/78; 215/12.1, 228, 215/280, 283, 222; 220/324, 254.8, 220/254.1, 315
See application file for complete search history.

(56) References Cited

U.S. PATENT DOCUMENTS

2003/0015533 A1* 1/2003 Niese ..... A47J 27/0813 220/315

* cited by examiner

*Primary Examiner* — Anthony D Stashick
*Assistant Examiner* — Raven Collins
(74) *Attorney, Agent, or Firm* — Greenblum & Bernstein, P.L.C.

(57) ABSTRACT

The invention concerns a cosmetic pot comprising a base and a lid that is configured to assume a closed position and an open position, and that further comprises at least one coupling member configured to assume a first position when the lid is in the closed position and to assume a second position, spaced apart from the first position, when the lid is in the open position. The lid comprises, in particular, a slide, with radial and eccentric double action, and a control stud configured to slide in relation to the slide between a first position and a second position, the coupling member assuming the first position of same when the stud is in the first position in relation to the slide and assuming the second position of same when the stud is in the second position in relation to the slide.

11 Claims, 6 Drawing Sheets

Fig. 7
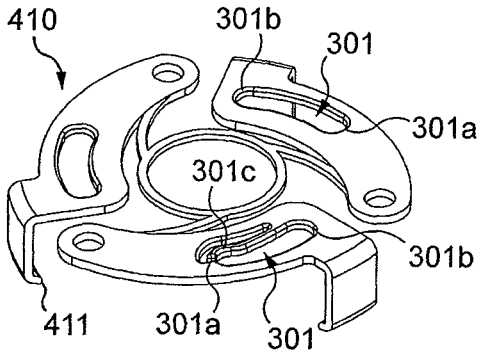
Fig. 8
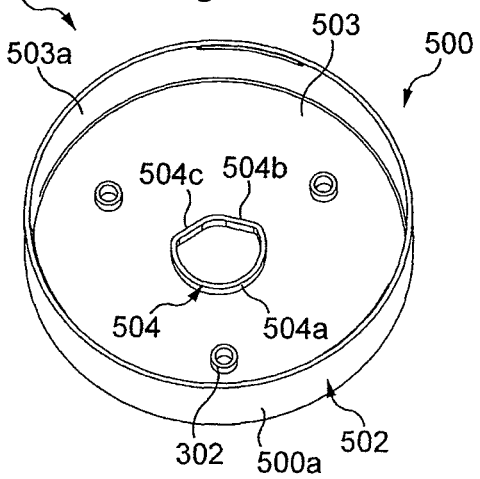
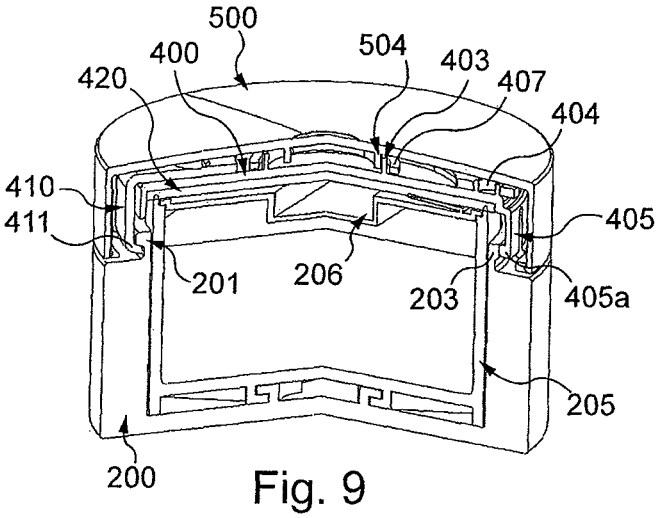
Fig. 9
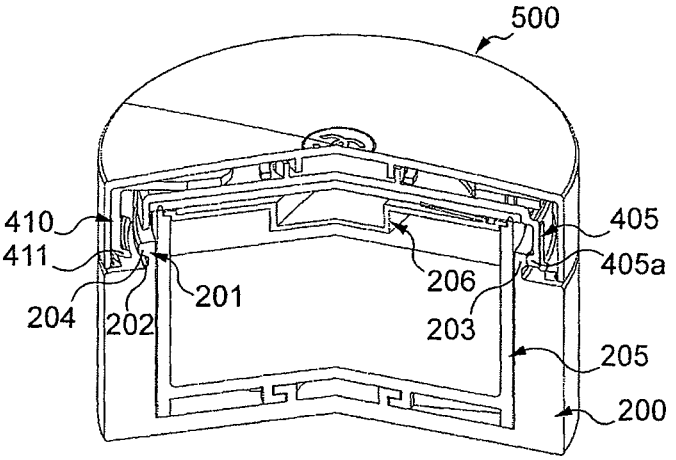
Fig. 10

COSMETIC POT COMPRISING A LID WITH A GUIDED COUPLING MEMBER

BACKGROUND

1. Field of the Invention

The invention concerns the field of pots, and in particular cosmetics pots.

2. Description of the Background

Conventionally, a cosmetic product pot comprises a base, generally of glass or plastic, that is to say a container surmounted by a neck of which the size of the diameter is in the vicinity of the cross section dimensions of the base, to have a wide opening. The base is closed by a lid, generally screwed onto the neck. The lid is furthermore generally equipped with a seal having the role of providing sealing for closing for good preservation of the product contained.

However, a drawback lies in the fact that the thread of the screw thread formation present on the neck requires there to be a neck clear from the rest of the base over a certain height and also a lid of a relatively great height. In words the presence of the screw thread formation imposes constraints in terms of dimensions for the height of the neck and the thickness of the lid.

Moreover, in particular for a round pot that has no stop for screwing, a user who closes the pot has difficulty determining when the tightening of the lid on the base is right. Excessive tightening over time induces crushing of the seal. Insufficient tightening means that the seal does not provide proper sealing. In both cases, air can enter the pot or volatile products of the formula, that is to say of the product contained in the pot, can escape from the pot, such that a risk arises of the formula degrading over time.

For a pot of non-circular shape of which the base and the lid have identical contours, the pot often has a stop in relation limits the angular travel of the lid in relation to the base so as always to have coinciding shape between the base and the lid. The presence of the stop thus prevents over-screwing, and therefore compensates for a loss of sealing in case the seal is crushed.

The document US2004/0067091 is known for example which describes a bottle, typically for nail polish, which enables closing by clipping the cap onto the container and opening by pressing on at least one button acting on an elastic ring. A spring device furthermore enables fluid-tight closing of the bottle to be provided to avoid any spilling of the product it contains. Such a cap however has the drawback of being particularly bulky, and in particular engendering a relatively great height to house the device therein. Furthermore, such an embodiment is suitable for a bottle of which the neck has a small diameter, but could be difficult to apply to a pot of which the neck has an appreciably greater diameter.

SUMMARY

To solve at least some of the aforementioned drawbacks, the present invention is directed to providing a pot with a lid that is simple to use to close or open a pot which enables reliability of closing to be ensured and which moreover leads to other advantages.

To that end, according to a first aspect a cosmetic pot is provided comprising a base and a lid to close the base, the base comprising a container surmounted by a neck provided with an indentation, and the lid being configured to take a closing position and an opening position, and further comprising at least one coupling member provided with a claw, the coupling member being configured to take a first position with the claw engaged in the indentation when the lid is in closing position and the pot is closed and to take a second position, in which the claw is away from the neck in relation to the first position and is disengaged from the indentation, when the lid is in opening position, the lid comprising an eccentric radial double action slide, and a guide stud configured to slide in relation to the slide between a first position and a second position, the coupling member taking the first position when the guide stud is in first the position in relation to the slide and the coupling member taking the second position when the guide stud is in the second position in relation to the slide.

The slide here is a double rail for opening and closing. It traces a path forming a guide for movement of the guide stud. According to another variant, the slide forms an oblong buttonhole. Or according to still another term, it forms a double cam, that is to say both a cam with an internal profile and a cam with an external profile nested into the cam with an internal profile, and which for example have the same shape.

Thus, one edge of the slide is active for opening, the other for closing. That is to say that one of the edges acts on the guide stud to move the claw away, that is to say enable a passage in opening position, whereas another of the edges acts on the guide stud to bring the claw closer, that is to say to return to closing position.

Such a pot enables coupling and sealing of the lid on the base with a reduced torque. Friction is furthermore lower than with a conventional coupling on screw threads.

For a round pot, it is also possible to achieve the closing of the pot for any angular position of the lid in relation to the base.

Furthermore, such a pot enables the same opening and closing movement to be performed as with a conventional pot of which the lid is screwed onto the base, that is to say for example with rotation in an anticlockwise direction to open the pot and in a clockwise direction to close it.

Such a pot also for example makes it possible to dispense with the presence of a coupling return member configured to link the coupling member to a lid support and to automatically bring back the coupling member into the first position.

Such a pot also makes it possible, for example, to dispense with the presence of a position return member which would be configured to automatically bring the lid back into closing position when the lid is placed in opening position.

More particularly, by virtue of such a pot, a user herself chooses to place the lid in closing position or in opening position according to need.

The slide possibly comprises a first end and a second end.

According to an exemplary embodiment, one of the first end or the second end is further from a center of rotation of the lid than the other of the first end or the second end.

The slide is for example bean-shaped.

According to an exemplary embodiment, the lid comprises an inside part, termed a coupling plate, and an outside part, termed a cap, the coupling plate and the cap being rotatably mounted in relation to each other. The lid for example takes the opening position when the cap is turned in relation to the coupling plate in relation to the closing position in an anticlockwise direction. Conversely, the lid for example takes the closing position when the cap is turned in relation to the coupling plate in relation to the opening position in a clockwise direction.

According to an advantageous exemplary embodiment, the coupling plate and the cap each comprise a central stud, substantially centered relative in relation to the cap. One of the studs is designated a male central stud and the other is designated a female central stud. The female central stud is for example formed from a contour wall which that comprises for example a circle arc portion and a flat (also designated planar portion). The male central stud is for example formed by a contour wall in relief or a solid shape and has for example an outside contour of which a portion traces a circle arc and of which two other portions are substantially planar and inclined in relation to each other. The male central stud advantageously comprises dimensions such that once the cap is assembled with the coupling plate, the male central stud is inserted into the female central stud with an outside surface of the circle arc portion of the male central stud being tangential to an inside surface of the circle arc portion of the female central stud. At the same time, one of the two planar portions of the male central stud is then tangential to the planar portion of the female central stud. The planar portions of the male central stud in cooperation with the planar portion of the female central stud thus form an angle stop for the rotation of the cap in relation to the coupling plate depending on whether the lid is in opening or closing position.

According to an exemplary embodiment, the coupling plate comprises a support, the coupling member being mounted on the support and movable in relation to it.

According to an exemplary embodiment, the coupling member comprises a small plate, for example from which extends a hook provided with a claw.

For example, the coupling member is pivotally mounted to the support of the coupling plate by the small plate, that is to say via the small plate.

According to an exemplary embodiment, the small plate is positioned parallel to an upper surface of the coupling plate support and is configured to pivot around an axis parallel to a pivotal axis around which the cap is configured to pivot in relation to the coupling plate.

According to another exemplary embodiment, the coupling plate comprises a radial groove configured to guide the coupling member in translation in relation to the coupling plate support between its first position and its second position.

According to an exemplary embodiment, the coupling member comprises the guide stud and the cap comprises the slide.

According to another exemplary embodiment, the coupling member comprises the slide and the cap comprises the guide stud.

According to an exemplary embodiment, the slide comprises an elastic tab configured to form a point of increased resistance at least when the lid passes from the opening position to the closing position.

According to an exemplary embodiment, the neck comprises a recess forming an angle stop at least when the lid passes from the closing position to the opening position, the recess being formed in a rim of the neck.

The recess is for example a cut-out in the rim such that the rim then has a locally reduced thickness.

According to an exemplary embodiment, the lid comprises at least three coupling members each comprising a claw and at least three slides and three corresponding guide studs.

BRIEF DESCRIPTION OF THE DRAWINGS

The invention, according to an exemplary embodiment, will be well understood and its advantages will be clearer on reading the following detailed description, given by way of illustrative example that is in no way limiting, with reference to the accompanying drawings in which:

FIG. 7 presents a first exemplary embodiment of a coupling member according to a first embodiment of the invention;

FIG. 8 presents a view of the inside, or from below, of a cap of the lid of FIG. 1 according to a first embodiment of the present invention and which is adapted to cooperate with the coupling plate of FIGS. 4 to 6;

FIG. 9 presents a cross section of the pot of FIG. 1 in closing position;

FIG. 10 represents a cross section of the pot of FIG. 1 in opening position;

DETAILED DESCRIPTION

Figure 1:
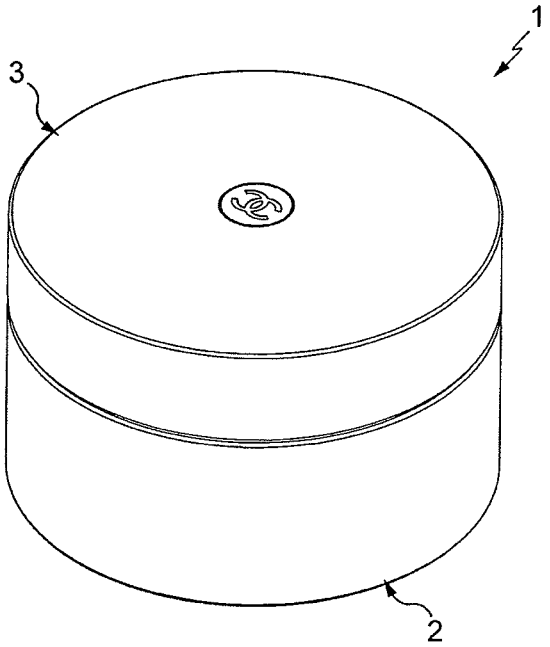
FIG. 1 shows a first exemplary embodiment of a cosmetic pot with a circular contour which comprises a base and a lid.

Identical parts represented in the aforementioned figures are identified by identical reference numerals.

The present description is mainly given with reference to a pot of circular contour but it would of course be valid for a pot of square or arbitrary contour. As a matter of fact, traditionally, a cosmetic pot 1 has a round contour like that in FIGS. 1 to 10, or substantially square, like that represented in FIGS. 11 and 12.

The pot 1 comprises a base 2 and a lid 3 enabling the pot 1 to be opened or closed.

The base is formed of any appropriate material, in particular glass or plastics material. It may be transparent or opaque.

Figure 2:
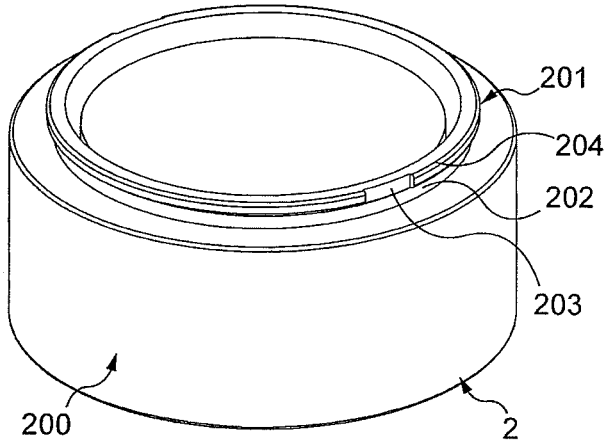
FIG. 2 presents the base of the pot of FIG. 1 according to a first embodiment of the present invention, comprising a neck of circular shape.
Figure 3:
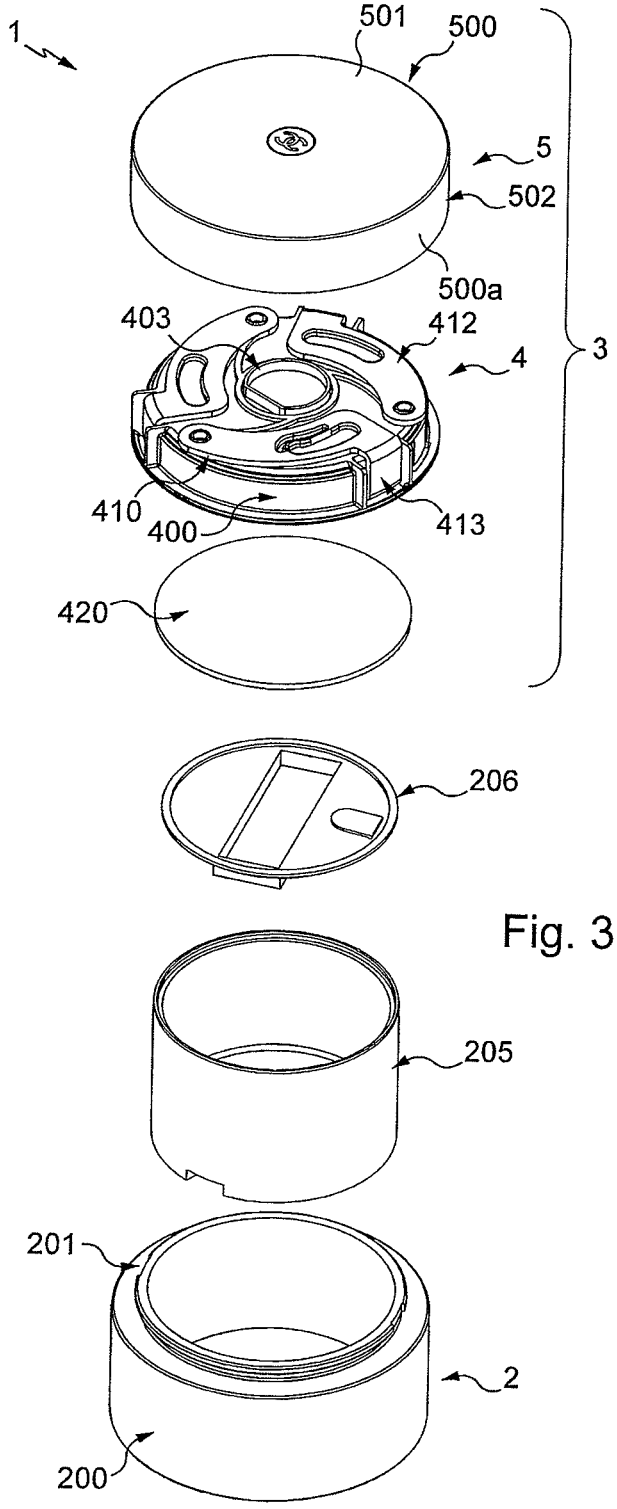
FIG. 3 presents an exploded view of the pot of FIG. 1.
Figure 4:
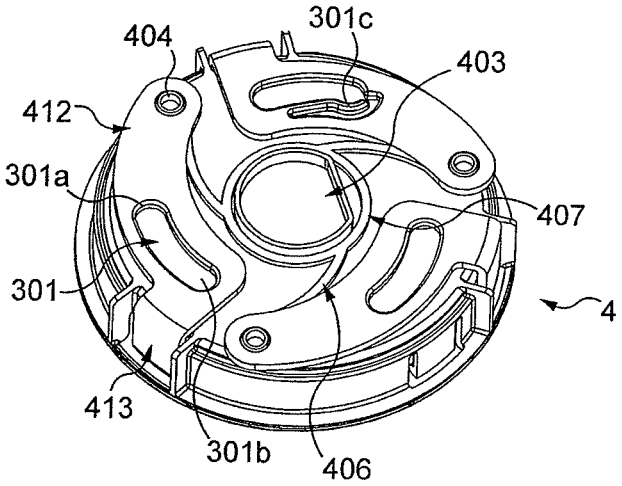
FIG. 4 presents a coupling plate of the lid of FIG. 1 according to a first embodiment of the present invention.
Figure 5:
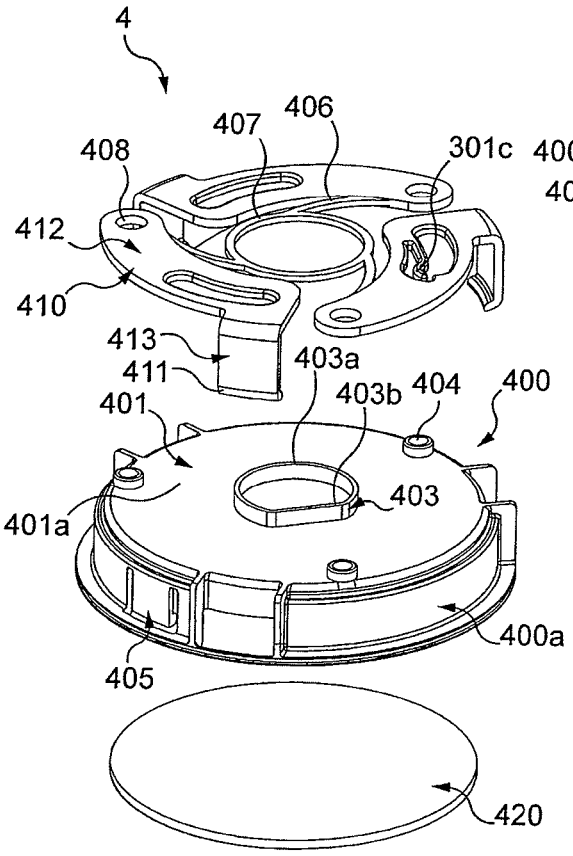
FIGS. 5 and 6 present an exploded view from above and an exploded view from below of the coupling plate of FIG. 4.
Figure 6:
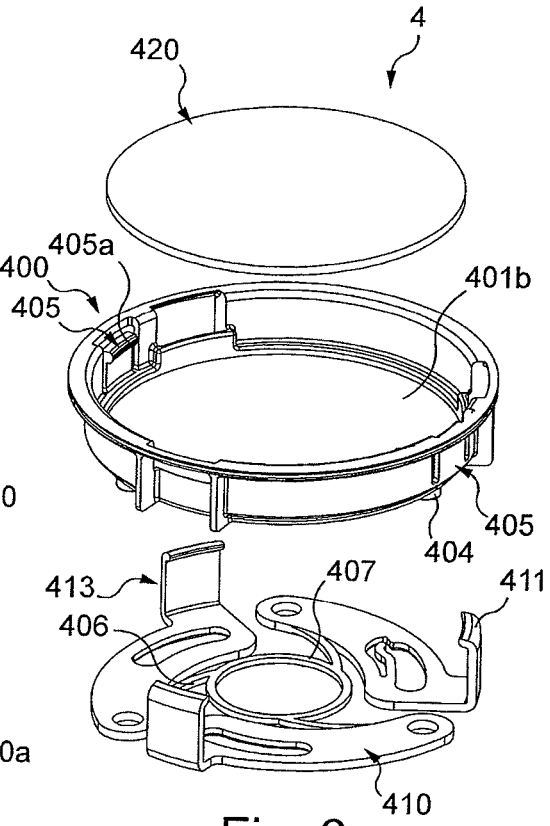

As is visible in FIGS. 2 and 3, the base 2 comprises a container 200 and a neck 201 which surmounts the container 200.

As illustrated in FIG. 3, the base may be provided to receive a mounted-on tub 205, also called cup, possibly provided with a covering closure 206, which contains the cosmetic product as in the case of a traditional pot. Thus, the cup and its closure are of course optional and the cosmetic product can just as well be contained directly in the container 200.

The neck defines an opening that enables access to a product contained in the container 200 (or in the cup). The dimensions of the neck and of the opening are in the vicinity of the cross-sectional dimensions of the base. Whatever the case, the opening of the pot is sufficiently wide to enable the passage of at least one finger of one hand, that is to say that it has, in cross section, a transverse dimension greater than or equal to approximately 25 millimeters.

The neck 201 here comprises an indentation 202 and a peripheral rim 204, under which is defined the indentation.

More specifically, in this example, the neck only comprises a single indentation 202 that extends continuously all around the neck 201. Furthermore, the indentation 202 is formed here on an outer periphery of the neck 201.

Preferably, an upper part of the rim 204 is rounded or beveled to create a ramp effect if a member is moved vertically against the neck.

The neck 201 thus here lacks any screw thread or screw ramp and compared to a conventional neck, it has a lower height. For example, as an indication, a square pot according to the invention has a height of approximately 95 mm with a neck of approximately 6.3 mm height and with an indentation of approximately 3.5 mm height, and approximately 1.5 mm depth. For a conventional pot of the same size, the height of the neck would have been of the order of 10.3 mm. These values are however given only as an indication.

Optionally, the neck may comprise an angle stop. This is for example the case here, in which the angle stop is formed for example by a recess 203 hollowed into the edge 204. The neck 201, at the location of the recess, then has a uniform thickness according to its height for example. Here, the neck only comprises a single stop of this type but it could of course comprise several of them. The function and the use of such a stop are described below.

As shown primarily in FIGS. 3 to 8, the lid 3 comprises a coupling plate 4 and a cap 5, rotatably mounted on the plate 4.

The assembly between the cap 5 and the coupling plate 4 is achieved by any appropriate means, for example by a circlips which retains the coupling plate 4 inside the cap 5, or for instance by snap engagement of the coupling plate 4 in the cap 5.

The cap 5 and the coupling plate 4 cooperate to enable easy opening and reliable closing of the pot 1 in use.

The lid 3 also comprises a seal 420, anchored under the coupling plate 4. The planar seal 420 is for example compressible, having a thickness of a few tenths of a millimeter, configured to be compressed over its periphery between the plate 4 and the neck 201 of the base 2. The planar seal 420 is formed of any appropriate elastically compressible material, in particular of polyethylene, SEBS, elastomer or any other equivalent material. As there is very little or no relative rotation between the coupling plate 4 and the neck 201, the planar seal 420 is not acted on, or is very little acted on, in shear, and it is possible to choose a relatively adherent material that has a high coefficient of friction.

Instead of such a compressible planar seal 420, an obturator plate mounted on a suspension and adorned with a seal of reduced thickness may be envisioned, as is described for example in patent application FR 2969127.

The coupling plate 4 comprises a support 400.

The support 400 is formed of any appropriate material, in particular from metal, for example by machining, or from plastic, for example by molding.

Whatever the external shape of the pot 1, the support 400 may have a generally cylindrical shape in order to facilitate rotation with the cap 5.

The support 400 comprises a contour wall 400*a* and a closing plate 401 comprising a face referred to as upper face 401*a* provided to be oriented towards the cap 5, and a face referred to as lower face 401*b*, which is substantially parallel to the upper face 401*a*, and provided to be oriented towards the base 2.

On the same side as the upper face 401*a*, the support 400 here comprises a central stud 403, referred to as female central stud 403, which is configured to form a pivot for the cap 5 which is described below.

The female central stud 403 is substantially centered in relation to the upper face 401*a*. It is hollow here, or in other words formed by a wall in relief in relation to the upper face 401*a*. The wall defining the female central stud 403 here forms a closed contour and here comprises a portion tracing a circle arc 403*a* and a planar portion 403*b*.

On the same side as the upper face 401*a*, the support 400 also comprises a pin 404 forming a center of rotation around which a coupling member 410 pivots when it passes between a first position and a second position, as described below The pin 404 is positioned here at the periphery of the upper surface 401*a*. In this case, as the pot 1 of the present exemplary embodiment comprises three coupling members 410, the support 400 thus comprises three pins 404.

Lastly, here, the support comprises an indexing tab 405, and even here two indexing tabs disposed diametrically opposite each other. The indexing tab 405 is formed here by a cut-out formed in the contour wall 400*a* of the support. It thus comprises a free edge, which is an opposite edge to an attachment edge by which it is linked to the support 400. The free edge comprises for example a bead 405*a*. The bead 405*a* is thus configured to cooperate with the angle stop, here the recess 203 of the neck 201 of the base. Any rotation of the plate 4 in relation to the base is thus limited, in particular on pivoting the cap 5 in relation to the plate 4 to open or close the pot. More particularly, in case of sliding of the plate 4 in relation to the base 2, the bead 405*a* slides along the edge 204 then comes into position in a recess 203, preventing the pivoting of the plate 4 in relation to the base 2 and thus facilitating the pivoting of the cap 5 in relation to the plate 4. Thus, so long as the bead 405*a* is out of a recess 203, the indexing tab 405 is elastically deformed by bending.

The indexing tab or tabs 405 and the recess 203 are however optional.

To grasp the lid 3 of the base 2, the coupling plate 4 comprises at least one coupling member 410. In the present exemplary embodiment, it comprises three identical coupling members 410, positioned at equal distances from each other, that is to say here every 120°, at the periphery of the support 400. To facilitate their manufacture and their installation, they are furthermore linked here to each other by branches 406, linking each of the coupling members 410 to a ring 407 adapted to be placed round the female central stud 403. These branches are however optional.

Each coupling member 410 is preferably formed in one piece, for example of metal or by molding from plastic material. It is even possible here for all the coupling members 410, the branches 406, and the ring 407 to be formed together as one piece.

Each coupling member 410 here comprises a small plate 412 and a hook 413 provided with a claw 411. In other words, the hook is linked to the small plate 412 by one of its ends and comprises the claw 411 at its opposite end to the aforementioned one.

In the present exemplary embodiment, when the coupling member 410 is positioned on the support 400, the small plate 412 extends substantially parallel to the upper face 401*a* and the hook 413 extends substantially at a right angle to the small plate 412, passing round the contour wall 400*a* of the support 400, the claw 411 then being positioned under the contour wall 400*a*, oriented towards a center of the support 400.

The claw 411 here has the form of a distinct rim curved towards the center of the support 400. Furthermore, the claw 411 here has a free end that is rounded to be consistent with the circular perimeter of the neck 201, with which is it provided to cooperate.

The claw 411 is thus configured to grasp the neck 201 of the base 2 by engaging in the indentation 202 under the rim 204 when the pot 1 is closed.

The small plate 412 comprises a hole 408 configured to cooperate with a pin 404 of the support 400 to form a pivot link between the corresponding coupling member 410 and the support 400.

In the present exemplary embodiment, the small plate 412 comprises a slide 301.

The slide 301 here is a cut-out in the small plate 412.

The slide 301 comprises a first end 301*a* and a second end 301*b*.

In this exemplary embodiment, the first end 301*a* is farther from a center of rotation of the lid 3 than the second end 301*b*. In other words, the first end is situated more to the periphery of the support 400 than the second end when the coupling member is mounted on the support 400.

Furthermore, the slide 301 has an oblong, curved shape, that is to say a bean shape.

Moreover, the slide 301 also here comprises an elastic tab 301*c* configured to form a point of increased resistance at least when the lid 3 passes from the opening position to the closing position. It is disposed between an inside edge and an outside edge of the slide and is positioned here on one side of the inside edge of the slide 301, that is to say of the edge situated towards a center of the lid 3 in relation to the outside edge. The elastic tab 301*c* comprises a free end, such that the elastic tab 301*c* forms a waiting blade in relation to the inside edge of the slide. The free end is furthermore situated on one side of the first end 301*a* of the slide and here partly forms that first end 301*a*; in other words, it is linked to the inside edge at a point situated between the free end and the second end 301*b*.

Furthermore, the elastic tab 301*c* optionally comprises a curved portion, here comprising the free end, forming an enlargement in relation to the outside edge and configured to receive a stud 302 (see FIG. 8), as described below.

Therefore, the slide comprising such an elastic tab is possibly wider and longer than the others, as shown by FIG. 7 for example.

Here, only one of the three slides 301 is provided with such an elastic tab. However, more or all of the slides could be so provided. The tabs could have any other appropriate shape. They are optional.

In the present exemplary embodiment, the cap 5 comprises a body 500. The body 500 comprises an upper face 501 (visible in FIG. 3 for example), a bottom 503 (visible in FIG. 8 for example), at the back of the upper face 501, and a contour wall 502.

The upper face 501 here constitutes an outside face, provided for example to be visible to a user when the pot 1 is closed. The upper face 501 is for example customizable, it is configured to receive decoration, for example in the form of varnish. According to an option not shown, the upper face is formed by one or more additional layers of openwork which are superposed in order to constitute the decoration, or for instance by an additional layer of marquetry. It may be produced from plastic, wood, glass or other materials. The upper face 501 is for example planar or domed.

The contour wall 502 extends from adjacent the bottom 503, preferably substantially at a right angle thereto.

The contour wall 502 comprises an outside contour surface 500*a*, that advantageously has the same shape as the outside contour of the base 2, and an inside contour surface 503*a*. Furthermore, the outside contour surface 500*a* is positioned at the periphery of the upper face 501; it is tangential to an edge of the upper face 501. The inside contour surface 503*a* is optionally of circular shape, at least in part, that is to say that, at least in part, that it forms a cylinder, with a diameter at least substantially equal to the diameter of the support 400 such that the cap 5 can pivot in relation to the coupling plate 4.

The cap 5 comprises a central stud 504, referred to as male central stud 504.

The male central stud 504 is substantially centered in relation to the bottom 503.

The central stud 504 is formed here by a wall in relief in relation to the bottom 503 which forms a closed contour, but could be a solid form.

It comprises here a portion 504*a* tracing a circle arc and two substantially planar portions 504*b* and 504*c* that are inclined in relation to each other.

The male central stud 504 furthermore comprises dimensions such that once the cap 5 is assembled with the coupling plate 4, the male central stud 504 is inserted into the female central stud 403 with an outside surface of the circle arc portion 504*a* of the male central stud 504 being tangential to an inside surface of the circle arc portion 403*a* of the female central stud 403. At the same time, one of the two planar portions 504*b* or 504*c* is then tangential to the planar portion 403*b*. The planar portions 504*b* and 504*c* in cooperation with the planar portion 403*b* form angle stops for the rotation of the cap 5 in relation to the plate 4 according to whether the lid is in an opening or a closing position.

The cap 5 further comprises a stud 302, here three studs 302 since there are three coupling members 410.

The studs 302 are positioned on the bottom 503, at equal distances from each other, that is to say approximately every 120° and at the same distance from a center of rotation of the cap 5 in relation to the plate 4.

Each stud 302 here has the form of a circular cylindrical finger projecting from the bottom 503.

Thus, once the cap 5 and the coupling plate 4 have been assembled together, each of the studs 302 is inserted into a slide 301 and can slide in relation to it between its first end 301*a* and its second end 301*b*.

Two operating positions of the lid are thus defined: a closing position (illustrated for example in FIG. 9), and an opening position (illustrated for example in FIG. 10).

When the lid is in the closing position, each of the studs 302 is positioned towards the first end 301*a* of the slide 301 and the coupling members 410 are then in first position, that is to say a position in which the corresponding claw 411 is in a position brought towards the center, such that when the lid is on the base, the claws 411 are engaged in the indentation 202, under the rim 204. Furthermore, the stud 302 cooperating with the slide 301 which comprises an elastic tab 301*c* is then held, retained, between the outside edge of that slide and the free end of the tab 301*c*, the latter then being elastically deformed and moved away from the outside edge of the slide.

When the lid is in the opening position, each of the studs 302 is positioned towards the second end 301*b* of the slide 301 and the coupling members 410 are then in the second position, that is to say a position in which the corresponding claw 411 is in a position moved away from the center in relation to the first position, such that, when the lid is initially on the base, the claws 411 are clear of the indentation 202 and can pass the rim 204, which enables the lid 3 to be separated from the base 2.

Considering for example the lid on the base, when the cap 5 is turned in relation to the plate 4 in an anticlockwise direction from the closing position, each of the studs 302 passes along the corresponding slide 301 from the first end 301*a* towards the second end 301*b*, which results in pivoting the coupling member 410 around its pin 404, in this case in a clockwise direction, thus inducing moving away of the claw 411 in relation to the neck of the base 2, that is to say that the claw then passes from a first position to a second position. In this case, each stud 302 then cooperates with an outside edge of the slide by pushing it away to move it away from a center of the lid.

If sliding inadvertently arises between the plate and the base when the cap is turned in relation to the plate, then one of the beads 405*a* slides along the rim 204 until it comes to be positioned in a recess 203, which blocks any relative rotation between the plate and the base so long as the claws are not cleared from the indentations.

To close the pot, once the lid is in the opening position positioned on the base, the cap 5 is turned in relation to the plate 4 in a clockwise direction; each of the studs 302 then passes along the corresponding slide 301 from the second end 301*b* towards the first end 301*a*, which results in pivoting the coupling member 410 around its pin 404, in this case in an anticlockwise direction, thus inducing movement of the claw 411 towards the neck of the base, that is to say that it passes back from its second position to its first position, such that it once again engages in the indentation 202. In this case, each stud 302 then cooperates with an inside edge of the slide by pushing it away towards a center of the lid. Furthermore, when the stud 302 cooperating with the slide 301 which comprises the elastic tab 301*c* reaches the first end 301*a* of that slide, it falls into the curved part of the elastic tab, which gives the user the sensation of passing a point of increased resistance.

The claws 411 of the coupling members 410 are thus configured in order for the free ends of the claws, in the first position, to be situated inside an imaginary circle of which the diameter would be the maximum diameter of the rim 204 of the base and, in the said position, for the free ends of the claws to be situated outside that imaginary circle.

Such a lid 3 is thus easily adaptable to any base 2, provided to contain a cosmetic product, comprising a neck 201 with at least one peripheral indentation 202.

Figure 11:
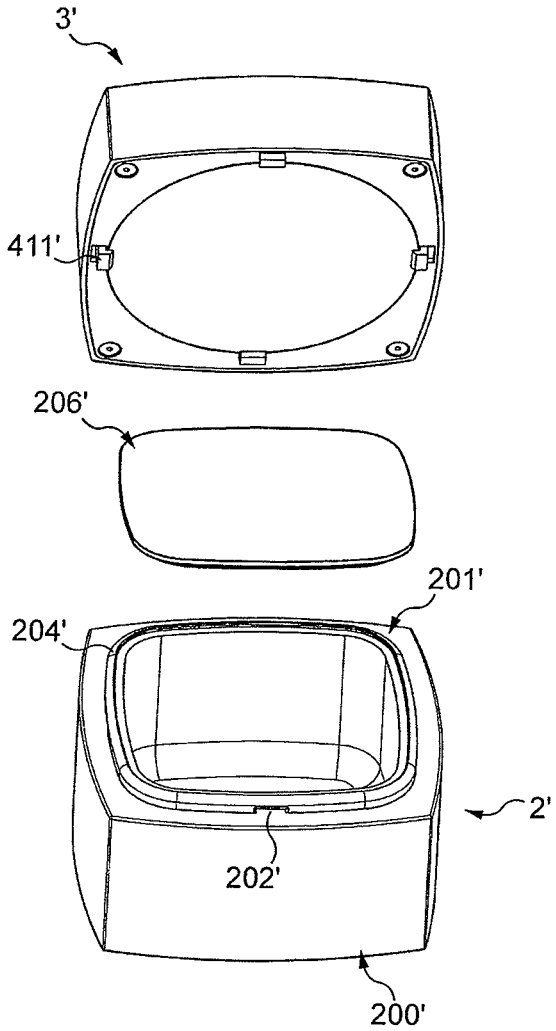
FIG. 11 shows a second embodiment of the present invention, comprising a cosmetic pot with a square contour with a neck of square shape.

FIG. 11 presents a pot 1' according to a second exemplary embodiment of the present invention.

Identical parts to those of the preceding embodiment are indicated by identical numerical references, surmounted by a "prime" sign and are thus not described again.

By way of example, the neck 201' of the pot of FIG. 11 is square here. Contrary to the usual pots, the opening of which enables the product to be accessed is not circular here, it has a shape that makes it very close to the outside contour of the base. As regards the lid, this has an outside shape that matches that of the base. Other non-circular shapes are also possible.

Furthermore, the neck 201' lacks any angle stop of the same type as the recess 203. As a matter of fact, the non-circularity of the opening directly enables angular indexing of the lid on the base.

On the other hand, the neck 201' comprises four indentations 202', each of them being situated substantially in the middle of the sides of the neck 201'.

Figure 12:
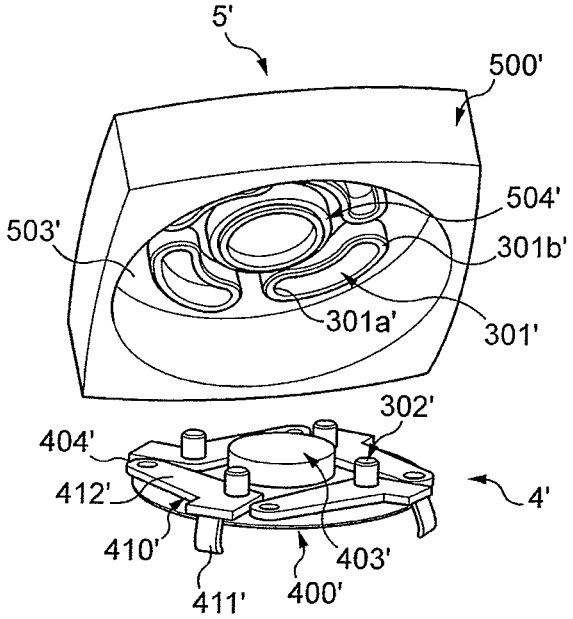
FIG. 12 presents a coupling plate and a cap of the lid of FIG. 11 according to a second embodiment of the present invention and separated from each other.

Correspondingly, the lid 3' comprises four coupling members 410', visible in FIG. 12.

As FIG. 12 shows, the disposition of the studs 302' and the slides 301' is swapped, i.e. the slides 301', which are four in number here too, are disposed here in the body 500' of the cap 5' and the studs 302' on the coupling members 410', projecting towards the cap 5' to be able to cooperate with the slides 301'. Furthermore, the slides 301' are formed here by a wall projecting in relation to the bottom 503' of the cap 5' which traces a contour, here closed. No slide here comprises an elastic tab, but at least one of them could comprise one, for example disposed between an outside edge and an inside edge of the slide.

Therefore, instead of being farther from the center, the first end 301*a'* of each slide 301' is closer to the center here. In other words, in this exemplary embodiment, the second end 301*b'* is farther from a center of rotation of the lid 3' than the first end 301*a'*; the second end is situated more to the periphery of the body 500 than the first end.

Thus, in this exemplary embodiment, a rotation of the cap 5' in relation to the plate 4' makes the coupling members 410' pivot inducing passage between the first position and the second position of the coupling members 410 and thus engagement or disengagement of the claws 411' in relation to the indentations 202'.

However, in this example, to open the pot, starting from the closing position, each stud 302' cooperates with an inside edge of the slide 301' which pushes it away while moving it away from a center of the lid, while to close the pot, each stud 302' then cooperates with an outside edge of the slide 301' which brings it back towards a center of the lid.

Furthermore, by way of illustration, the central stud 403' of the plate 4' is a male stud here and the central stud 504' of the cap 5' is a female stud. These studs furthermore lack any planar portion. This could of course be transposed to the preceding embodiment (swapping of the studs and/or elimination of the planar portions for example).

Figure 13:
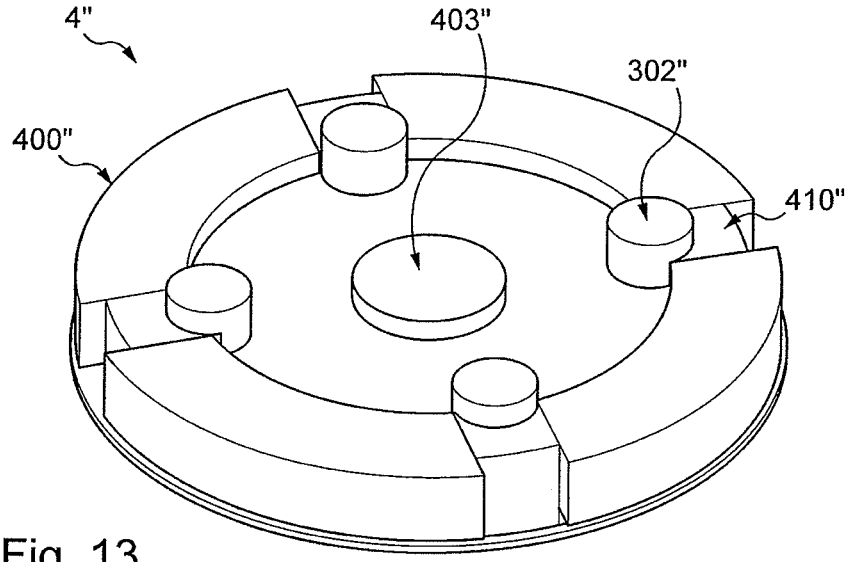
FIG. 13 presents a coupling plate according to a third embodiment of the invention.
Figure 14:
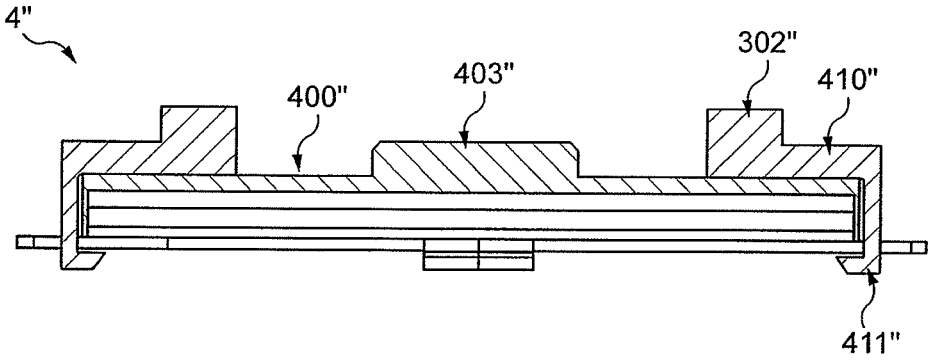
FIG. 14 illustrates a cross section view of the plate of FIG. 13.

FIGS. 13 and 14 present a third exemplary embodiment of the present invention.

Identical parts to those of the preceding embodiments are indicated by identical numerical references, surmounted by a "double prime" sign and are thus not described again.

In this third example, the coupling members 410" are mounted for translational movement in relation to the plate 4".

This embodiment comprises, like the preceding one, four coupling members 410" that are for example configured to cooperate with the same cap 5' as that of FIGS. 11 and 12 and possibly the same base 2' as that of FIG. 11 or even that of FIG. 2.

In this case, a rotation in an anticlockwise direction, starting from the closing position, of the cap in relation to the plate, induces a translation of the coupling members 410" driving a movement away of the claws 411" and a rotation in a clockwise direction, starting from the opening position, of the cap in relation to the plate, induces a translation in the opposite direction of the coupling members 410" driving the claws 411" closer.

In the various embodiments of construction that have been described, the passage from the opening position to the closing position and the opposite passage are performed with a smaller torque than for a traditional pot with a screw lid. The first reason for this is that there is no, or almost no, sliding of the seal against the neck of the base. The second reason is that the mechanical forces for closing and opening are brought towards the center of the lid. Due to this, the tightening or untightening torque that a user must apply to the lid to close or open the pot is smaller than for a screw pot in which the forces are localized towards the periphery of the lid.

The present invention is limited neither to the preceding description nor to the appended drawings, but encompasses any variant form within the capability of the person skilled in the art.

The invention claimed is:

1. A cosmetic pot comprising:

a base comprising a container surmounted by a neck provided with an indentation; and a lid to close the base and open the base, selectively;

the lid being configured to take a closing position and an opening position, selectively, the lid comprising:

at least one coupling member having a claw;

a coupling plate comprising a support, the coupling member being mounted on and movable in relation to the support;

the coupling member being configured to take a first position and a second position, selectively;

in the first position, the claw is engaged in the indentation of the base when the lid is in the closing position and the lid is in the closing position;

in the second position, the claw is away from the neck of the base in relation to the first position of the coupling member, and is disengaged from the indentation of the base, when the lid is in the opening position;

the lid further comprising an eccentric radial double action slide, and a guide stud configured to slide in relation to the slide between a first guide stud position and a second guide stud position;

the coupling member taking the first position when the guide stud is in the first guide stud position in relation to the slide; and the coupling member taking the second position when the guide stud is in the second guide stud position in relation to the slide.

2. A cosmetic pot according to claim 1, wherein:

the slide is bean-shaped, the slide comprising a first end and a second end; and one of the first and second ends of the slide is farther from a center of rotation of the lid than another of the first and second ends of the slide.

3. A cosmetic pot according to claim 1, wherein:

the lid comprises:

an inside part comprising the coupling plate; and an outside part comprising a cap;

the coupling plate and the cap are rotatably mounted in relation to each other;

the lid takes the opening position when the cap is rotated in relation to the coupling plate in an anticlockwise direction from the closing position.

4. A cosmetic pot according to claim 1, wherein:

the coupling member comprises a small plate pivotally mounted to the support of the coupling plate by the small plate.

5. A cosmetic pot according to claim 4, wherein:

the small plate is positioned parallel to an upper surface of the support of the coupling plate and is configured to pivot around an axis parallel to a pivotal axis around which the cap is configured to pivot in relation to the coupling plate.

6. A cosmetic pot according to claim 1, wherein:

the coupling plate includes a radial groove configured to guide the coupling member in translation in relation to the support of the coupling plate between the first and second positions of the coupling member.

7. A cosmetic pot according to claim 1, wherein:

the coupling member comprises the guide stud and the cap comprises the slide.

8. A cosmetic pot according to claim 1, wherein:

the coupling member comprises the slide and the cap comprises the guide stud.

9. A cosmetic pot according to claim 1, wherein:

the slide comprises an elastic tab configured to form a point of increased resistance at least when the lid passes from the opening position to the closing position.

10. A cosmetic pot according to claim 1, wherein:

the neck comprises a recess forming an angle stop at least when the lid passes from the closing position to the opening position, the recess being formed in a rim of the neck.

11. A cosmetic pot according to claim 1, wherein:

the at least one coupling member of the lid comprises at least three coupling members, each comprising a claw, a slide and a stud.

* * * * *